US006558442B2

(12) United States Patent
Donovan et al.

(10) Patent No.: US 6,558,442 B2
(45) Date of Patent: May 6, 2003

(54) SYNTHETIC FUEL PRODUCTION METHOD

(75) Inventors: Paul Donovan, Parsonsfield, ME (US); William Tis, Verona, PA (US)

(73) Assignee: Entac, Inc., Parsonfield, ME (US)

( * ) Notice: Subject to any disclaimer, the term of this patent is extended or adjusted under 35 U.S.C. 154(b) by 0 days.

(21) Appl. No.: 09/939,229

(22) Filed: Aug. 24, 2001

(65) Prior Publication Data

US 2002/0020109 A1 Feb. 21, 2002

Related U.S. Application Data

(60) Provisional application No. 60/228,976, filed on Aug. 30, 2000.

(51) Int. Cl.[7] ..... C10L 9/02

(52) U.S. Cl. ..... 44/620; 44/628; 44/542; 44/545

(58) Field of Search ..... 44/280, 620, 542, 44/545, 628

(56) References Cited

U.S. PATENT DOCUMENTS 4,304,573 A * 12/1981 Burgess et al. ..... 44/280
4,357,145 A 11/1982 Dondelewski
4,385,995 A 5/1983 Dondelewski
4,389,218 A 6/1983 Pike
4,396,394 A * 8/1983 Li et al. ..... 34/391
4,396,395 A * 8/1983 Skinner et al. ..... 44/501
4,410,431 A * 10/1983 Roe ..... 106/13
4,551,179 A * 11/1985 Mark ..... 106/277
4,642,196 A 2/1987 Yan
4,828,576 A * 5/1989 Bixel et al. ..... 44/501
5,231,797 A 8/1993 Davis et al.
5,238,629 A 8/1993 Davidson
5,322,530 A 6/1994 Merriam et al.
5,453,103 A 9/1995 Ford
5,599,361 A 2/1997 Ford
5,743,924 A 4/1998 Dospoy
5,895,347 A 4/1999 Doyle
5,916,826 A 6/1999 White
6,013,116 A 1/2000 Major et al.

* cited by examiner

*Primary Examiner*—Cephia D. Toomer
(74) *Attorney, Agent, or Firm*—Patricia M. Mathers; Thomas L. Bohan

(57) ABSTRACT

A process of making coal fines into a commercially viable fuel product using tall oil and tall oil pitch emulsions. The tall oil based emulsions are sprayed into, and reacted with, the coal fines, resulting in a cost effective and industry-usable source of synthetic fuel.

19 Claims, 6 Drawing Sheets

SYNTHETIC FUEL PRODUCTION METHOD

This application claims priority to provisional application No. 60/228,976, filed Aug. 30, 2001.

BACKGROUND OF THE INVENTION

1. Field of the Invention

This invention relates generally to the production of non-traditional fuels, often referred to as synthetic fuels. More particularly, this invention relates to the creation of such fuels using existing stockpiles of coal fines, coal dust, and other similar small particles of virgin coal. More particularly yet, this invention relates to using emulsions of tall oil and tall oil pitch, a by-product of the paper industry, in the creation of such fuels.

2. Description of the Prior Art

For centuries coal has been mined as a source of fuel. During these years, numerous improvements have been made to increase mining efficiency and safety, and to improve the overall quality and purity of the end product However, one drawback of coal mining is the by-product of coal fines that frequently end up abandoned into waste pits scattered throughout the countryside. These coal fines constitute up to 20% of the coal being mined, and are found in the waste stream generated by the initial washing and filtering of the coal from the mine. Although coal fines include particles as small as dust motes, the term can also include pieces of coal up to about one-half inch in diameter. This material has traditionally been abandoned to waste, deposited in the form of "coal tips," because it has been economically inefficient to handle such sizes as they are brought to the point of being burned for their energy content. As a result, literally millions of tons of such material have been produced over the years, and currently lay dormant at or near mining sites. Not only does this non-use pose a great waste of valuable natural fuel resources, but it also poses a threat to the surrounding environment. In addition to respiratory hazards presented by the dust-sized particles, the large surface area associated with stockpiles of such particles poses a high risk for spontaneous combustion such as the type known as a dust explosion.

These environmental issues, together with the growing concern of the limited existing amount of natural fuel resources, has led to an increased interest in utilizing these dormant coal fines, as well as developing an alternative use of virgin coal.

Attempts to utilize coals fines as fuel include the method disclosed in White (U.S. Pat. No. 5,916,826; issued 1999), which teaches a method of pelletizing and briquetting coal fines using bio-binders produced by liquefaction of biomass. Unfortunately, this process is extremely costly, primarily because of the required liquefaction process, which is carried out in an oxygen-free environment at elevated temperatures—between 450° and 700° F.—and elevated pressures, typically between 200 psi and 3,000 psi. The resulting liquid is then sprayed on coal fines that have themselves been heated to at least 250 degrees F., after which the coal and the liquid are allowed to react at about 300–400 degrees F. Although this method serves to alleviate certain environmental concerns, the high costs of reclaiming coal using this process undercuts the basic usefulness of the invention itself.

Another recent example of the attempt to use coal fines as fuel, Ford (U.S. Pat. No. 5,453,103; issued 1995), discloses a method of forming solid fuel pieces from coal fines by combining and mixing water, hydrochloric acid, a conditioner, and a polyvinyl acetate (PVA) emulsion and then compressing the resulting slurry into solid fuel pieces. Although this process is effective, its requirement of PVA, which must be separately created for this particular use, makes the Ford process economically and environmentally inefficient in comparison with a process founded entirely on the use of constituents that are already present, and which some of the constituents are not being devoted to any economical purpose. In other words, a process that consumed both coal fine waste and another hitherto waste element would be more desirable than the Ford process.

A process that does use as input primarily waste products from other industrial operations is revealed by Major (U.S. Pat. No. 6, 013,116; issued 2000), which teaches a composition for binding coal fines into larger pieces, typically called briquets. The briquet-binder composition of Major can be produced using an asphalt base, sodium carbonate pulping liquor, and a surfactant. However, for optimal binding results, strength-increasing additives such as latex, vinyl derivatives, cellulose, cellulose derivatives, peat moss, starch, starch derivatives, and various pulps need to be added to the binder composition. (The addition of lignosulfate, cement, rubber, and plastics is also taught by Major.) Although this process does use various waste products of other industries in transforming coal fines into a more usable fuel source, the complexity of the binding material makes the process quite complex, thereby reducing the economic viability of the overall method.

An older process of reclaiming coal fines is disclosed in Dondelewski (U.S. Pat. No. 4,357,145; issued 1982). In Dondelewski, coal fines are combined with a liquid by-product of the pulp and paper industry, namely a liquid containing tall oil, tall oil pitch, or mixtures thereof ("tall oil mix"). Tall oil and tall oil pitch are by-products from the digestion of wood by the Kraft (sulfate) paper manufacturing process. In the Dondelewski method, the coal fines are first put into the form of a slurry by mixing them with water. After the slurry has been formed, it is fed to a conditioning tank where it is mixed with tall oil mix. In the conditioning tank, the tall oil mix adheres to and thus coats the surfaces of the individual coal particles, after which the slurry of now-coated coal particles and excess tall oil mix is introduced into a flotation cell, where the coated coal particles are separated from the excess tall oil mix and most of the water. Vacuum filters, vibratory screens and centrifuges may be used to remove excess liquid, a necessary step since most coal—consuming furnaces cannot tolerate a high moisture content. Again, although the process of Dondelewski has as its feed stock predominantly industrial by-products, it is very process intensive, first requiring large vats to mix the coal slurry and tall oil mix, then further processing to remove excess water and tall oil mix followed by drying the end product. Thus, the method of Dondelewski does not satisfy the condition of using industrial by-products to produce a synthetic fuel that is economically competitive with the fuels that the synthetic fuel is intended to supplant, or which in general is in competition with it as a fuel source.

Therefore, what is needed is an economical and environmentally friendly method of using industrial by-products traditionally discarded as waste as the feed stock for a new fuel. What is more specifically needed, in view of the millions of tons of coal fines deposited throughout the landscape, is such a method that uses coals fines as all or part of the feed stock. Finally, what is needed is such a process that by whatever means results in a fuel that is economically viable in the marketplace, so that industries now holding hegemony over the referenced industrial by-products, and in particular the coal fines, will be induced to use up those by-products, removing them from the category of stored and hazardous waste.

SUMMARY OF THE INVENTION

It is an object of the present invention to use coal fines and other industrial by-products in the creation of a commercially viable fuel. Another object of the present invention is to use such hitherto waste products in a process that is environmentally friendly. A further object of the invention is to provide such a process that will reduce the overall cost of production, so as to provide industry the economic incentives to make use of the coal fines.

As set out above, the term "tall oil mix" refers to tall oil, tall oil pitch, or any combination thereof. This tall oil mix may be modified to the extent that fatty acids, rosin acids, sterols and other constituents may be added or subtracted. From this point on in the discussion, the term "coal fines" is used as a collective designation for coal fines, coal dust, and all other coal particles that can be used as feedstock for alternative fuels, as well as for coal fines, coal dust, and all other coal particles that could be used directly as a traditional fuel source but for the fact that some of them are too small to be able to reach their full economic potential given the present technology. The term "tall oil emulsion" refers to any tall-oil-mix, suspension or solution, in water.

The method of the present invention meets the invention's objectives by combining the solids of tall oil mix with coal fines, and more particularly with all or essentially all of the individual particles constituting the coal fines being processed. More particularly, the method of the present invention involves spraying tall oil emulsion into a stream of coal fines, typically an air stream of coal fines formed by letting the coal fines fall under gravity past a spray of tall oil emulsion directed substantially at right angles to the stream.

As mentioned earlier, tall oil and tall oil pitch are by-products of the digestion of wood by the Kraft (sulfate) paper manufacturing process. Tall oil is 100% organic, non-toxic and non-hazardous to handle. Based on tests carried out on behalf of the inventor, it appears that tall oil reacts chemically with the coal fines after the two components have been brought together according to the method of the present invention. The fuel produced by the present invention is a synthetic fuel in the sense of a synthetic fuel being a fuel "which does not exist in nature . . . [but rather] is synthesized or manufactured from varieties of fossil fuels which cannot be used conveniently in their original form." [*McGraw-Hill Encyclopedia of Science and Technology*, McGraw-Hill, Inc., 1982.] Moreover, it is a synthetic fuel produced by a method resulting in a significant chemical change, based upon the infra-red absorption spectra of the fuel in comparison with the infra-red absorption spectra of the fuel's constituents prior to processing.

Additionally, when tall oil is combined with coal fines it will contribute in excess of 50,000 Btu's per gallon applied, based upon a 40% solids content tall oil emulsion. It is to be emphasized here that unlike prior-art uses of tall oil, the present method is not aimed at simply producing agglomerations of the basic coal particles. Rather, it is used to produce fuel that continues to exist in small particulate form, but with the tall-oil-mix solids combined with the particulate. In carrying out this method, tall oil emulsion has numerous process advantages over the prior art methods. It can be directly sprayed into passing or free falling coal fines, thereby eliminating the necessity of having large mixing vats to coat the coal fines. Additionally, directly applying tall oil emulsions into the coal fines eliminates the need to separate the coal fines from the tall oil mixing slurry of the prior art. Elimination of these cost intensive process steps makes the processing of coal fines into a usable fuel a more economical option, and therefore providing industry an incentive to use this fuel source. Tall oil emulsions may be prepared in a variety of methods that are well known in the art. Another benefit of using tall oil emulsions is that, in contrast with the relevant prior art described above, they may be applied to the coal fines at a specific rate and specific concentration, with no requirement for removing excess material via, centrifuges and/or dryers. For example, the tall oil emulsion may be adjusted to contain the desired amount of tall oil to be applied to the coal fines, thus eliminating waste of valuable tall oil resources. The emulsion may be simply sprayed through various nozzles into the coal fines either in free fall or on conveyor belts. Once sprayed, the treated coal fines need no or little drying, as the water from the emulsion evaporates as part of the process. The treated coal fines can be sent to an agitator to further facilitate even distribution of the emulsion throughout the coal fines, and/or continue on to be agglomerated by a briquetting or pelletizing apparatus. Nevertheless, it is the process of combining the coal fines with the tall-oil solids that constitutes the heart of the present invention.

DETAILED DESCRIPTION OF THE PREFERRED EMBODIMENT

Figure 1:
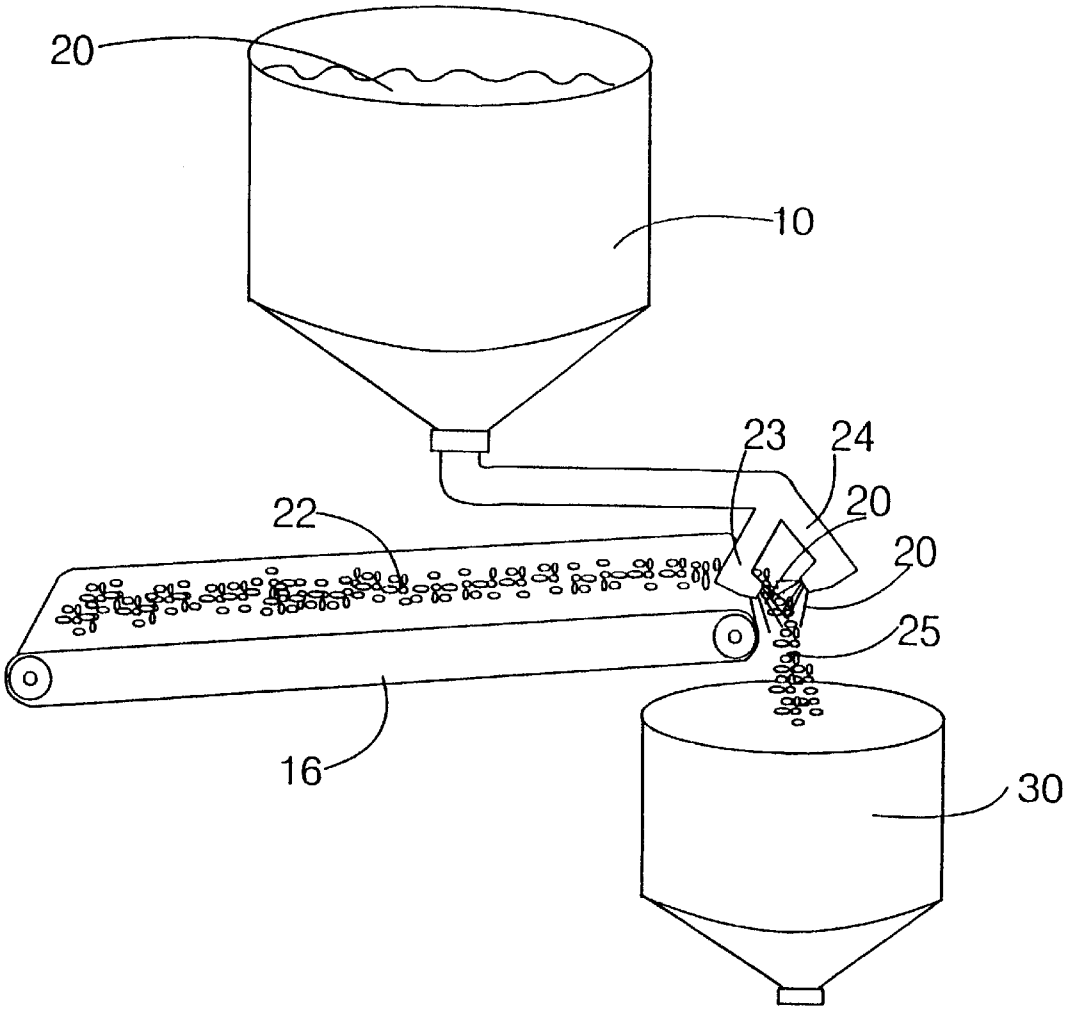
FIG. 1 is diagrammatic view of the application process in which emulsified tall oil is joined with coal fines.
Figure 2:
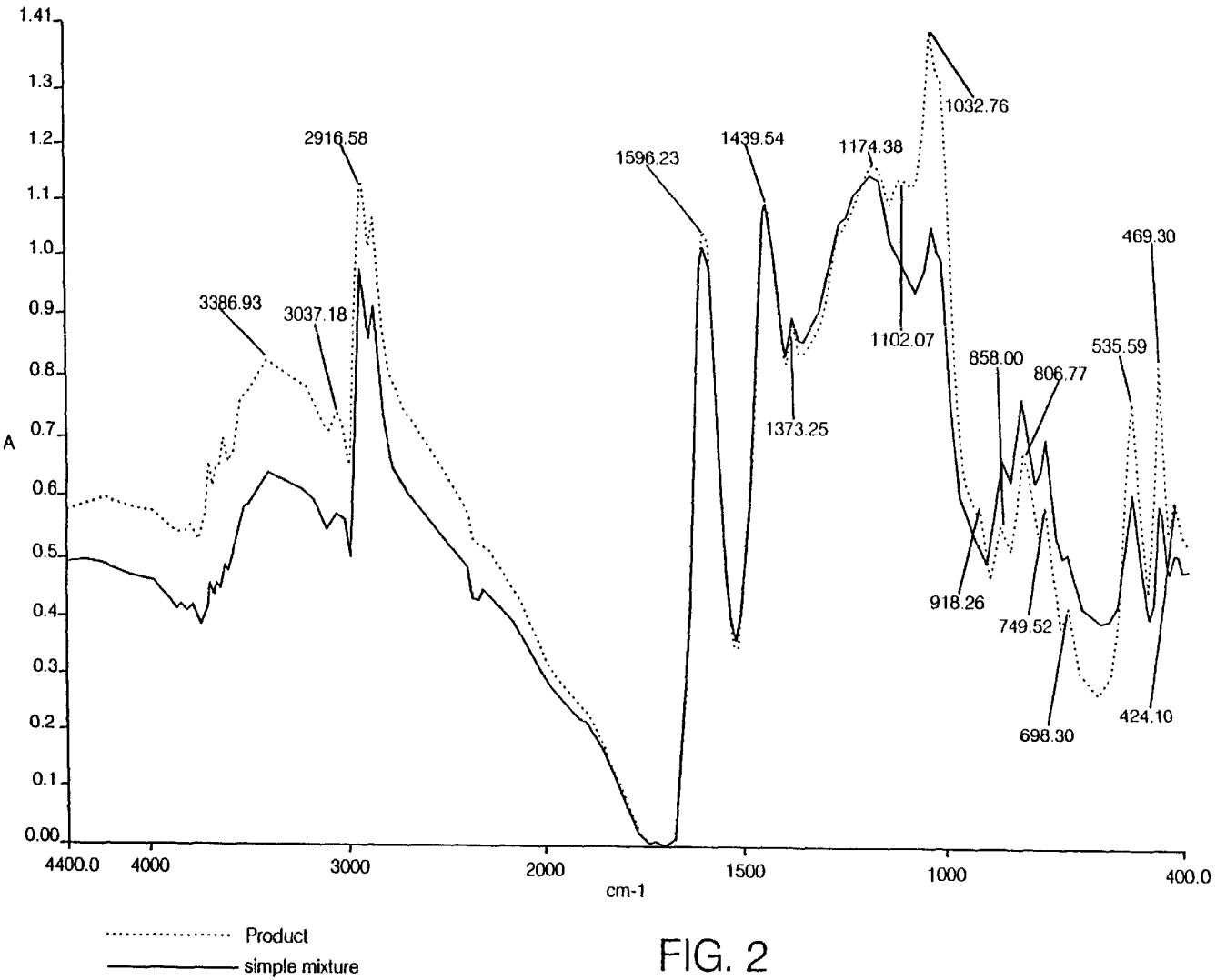
FIG. 2 is a graphical Fourier Transform Infrared (FTIR) analysis, comparing a solid synthetic fuel consisting of coal fines treated with a 40% solids tall oil emulsion at 0.5% by weight of coal versus the starting materials.
Figure 3:
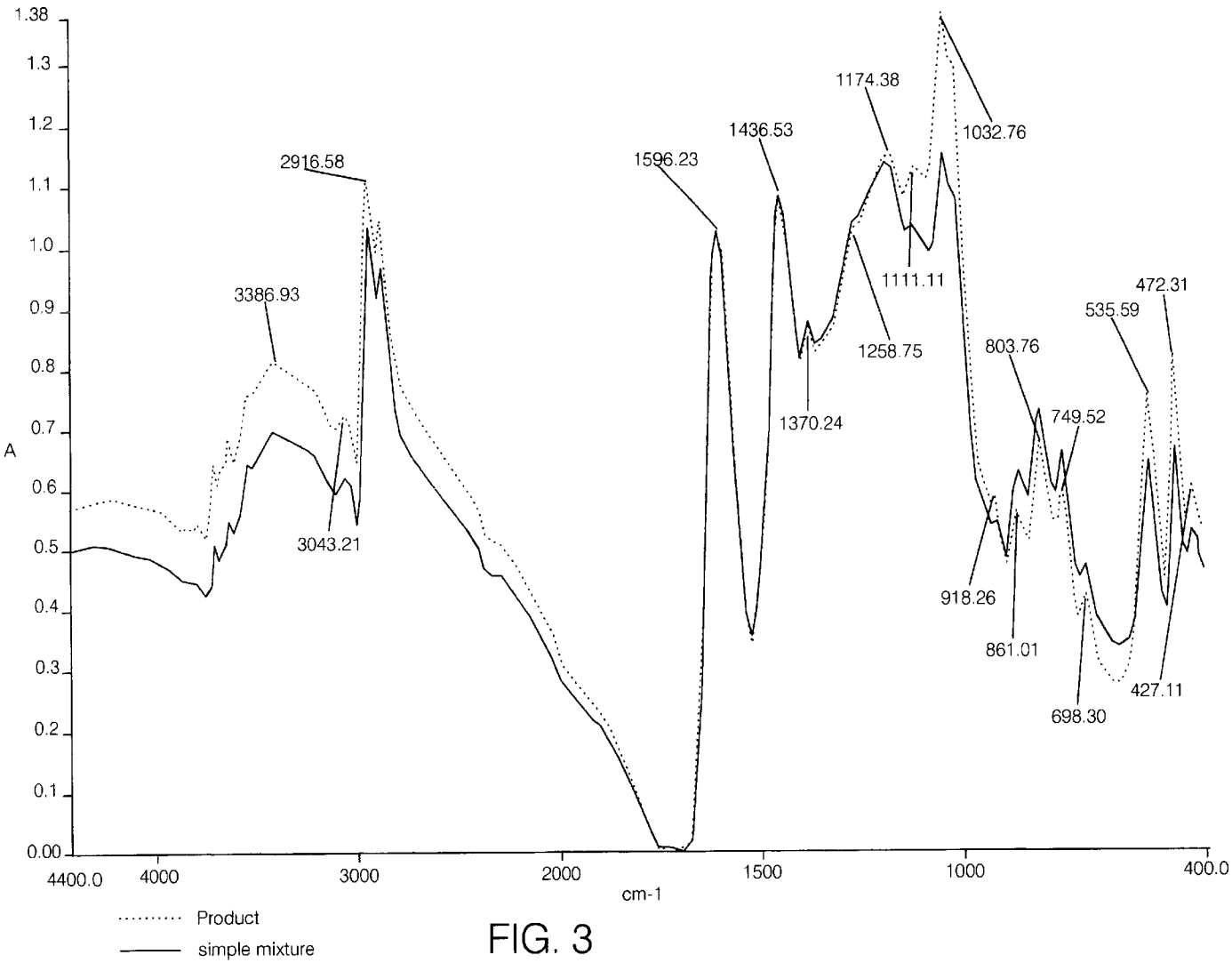
FIG. 3 is a graphical Fourier Transform Infrared (FTIR) analysis, comparing a solid synthetic fuel consisting of coal fines treated with a 40% solids tall oil emulsion at 0.75% by weight of coal versus the starting materials.
Figure 4:
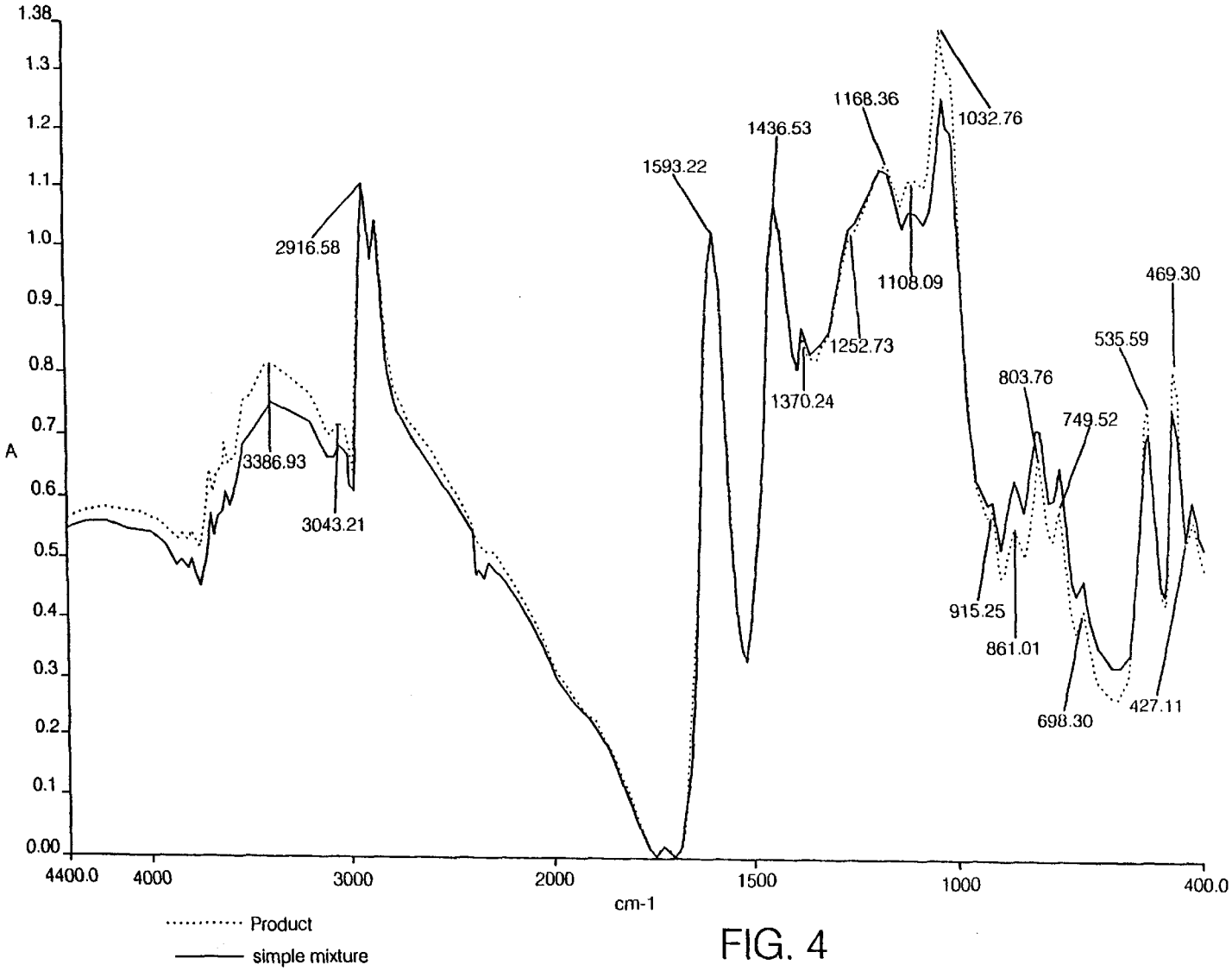
FIG. 4 is a graphical Fourier Transform Infrared (FTIR) analysis, comparing a solid synthetic fuel consisting of coal fines treated with a 40% solids tall oil emulsion at 1.0% by weight of coal versus the starting materials.
Figure 5:
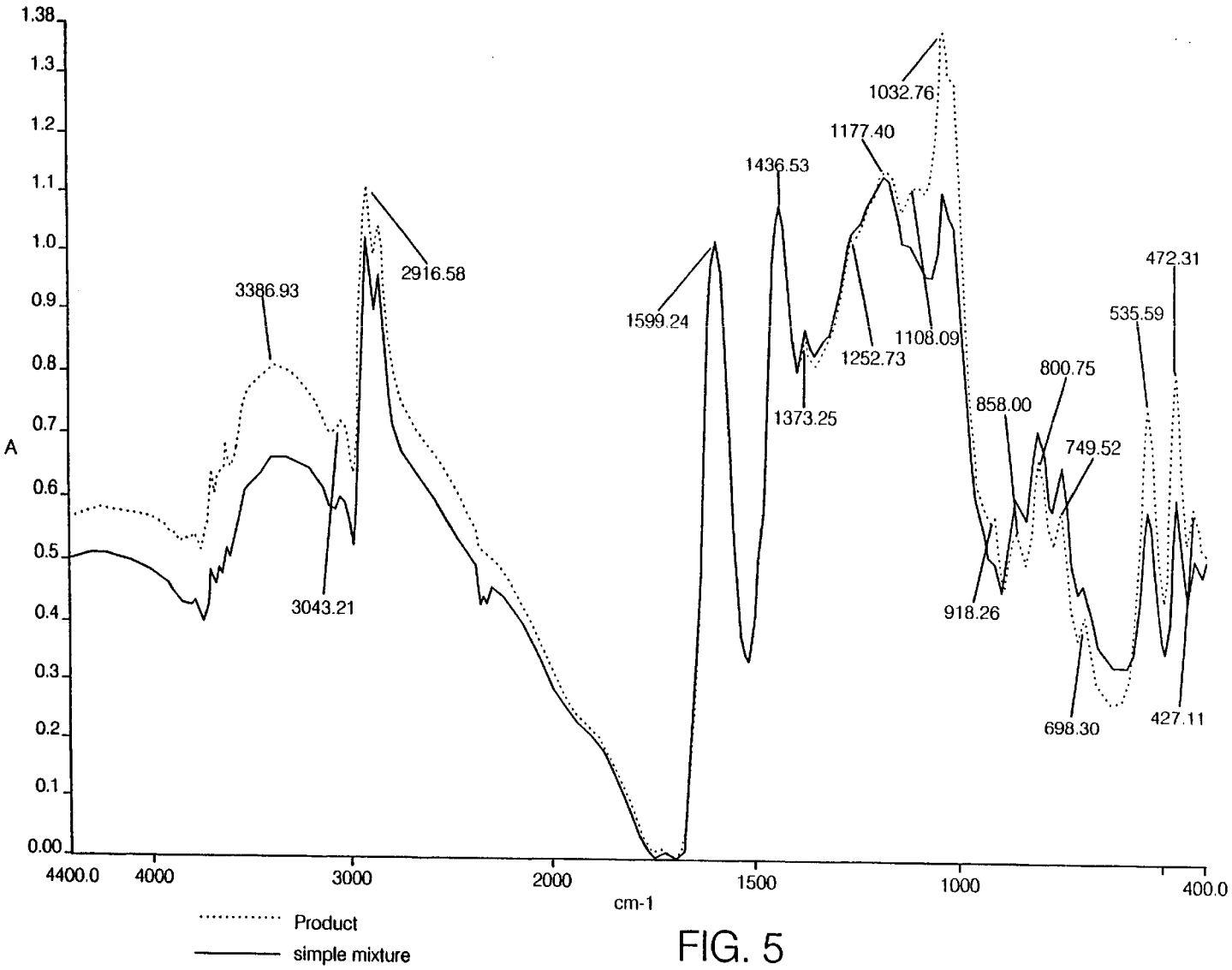
FIG. 5 is a graphical Fourier Transform Infrared (FTIR) analysis, comparing a solid synthetic fuel consisting of coal fines treated with a 40% solids tall oil emulsion at 1.25% by weight of coal versus the starting materials.
Figure 6:
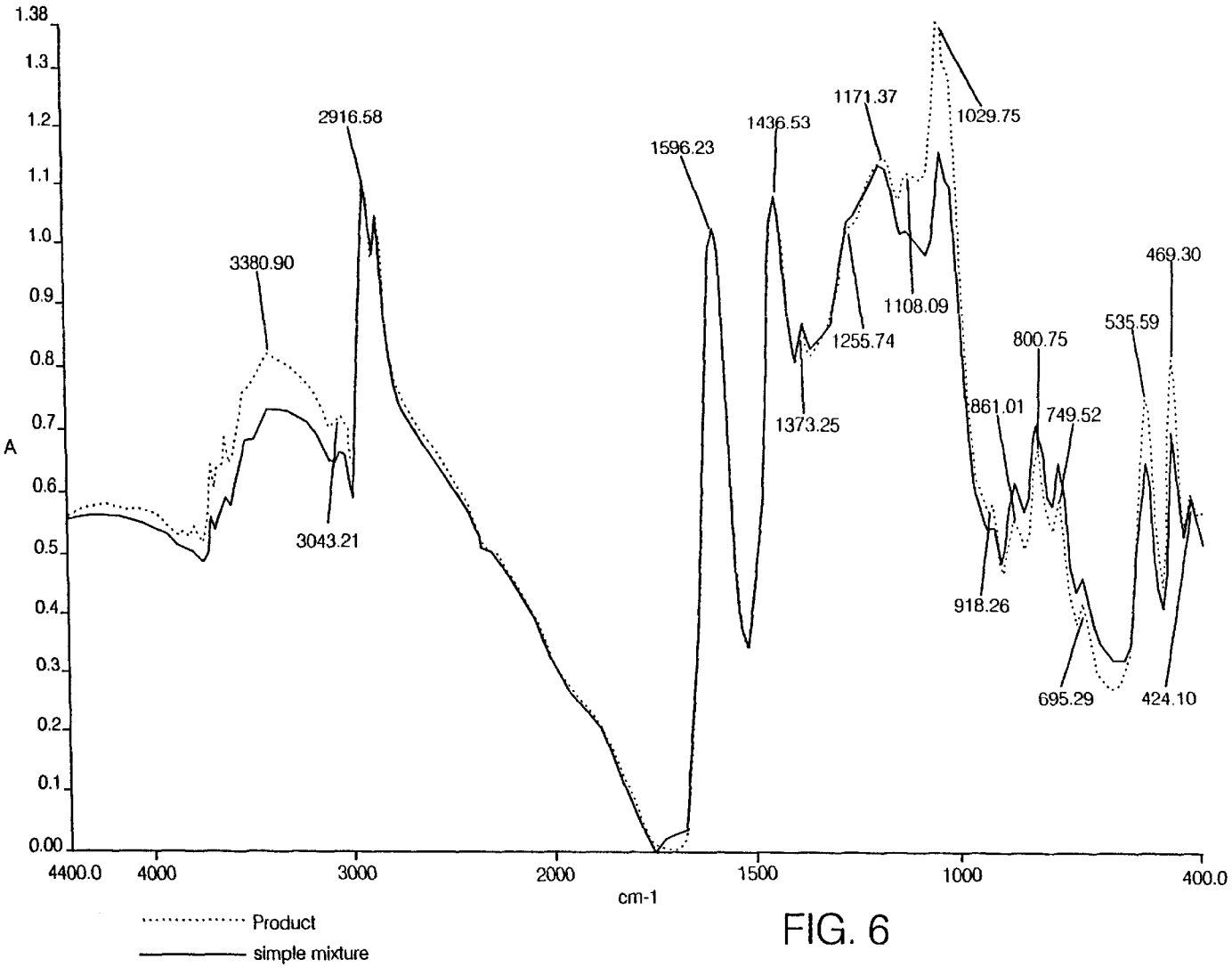
FIG. 6 is a graphical Fourier Transform Infrared (FTIR) analysis, comparing a solid synthetic fuel consisting of coal fines treated with a 40% solids tall oil emulsion at 1.5% by weight of coal versus the starting materials.

The particular technique used to create the tall oil based suspension in the Preferred Embodiment of the present invention is as follows. Although the following description illustrates a batch system of production, an automated system can, of course, also be employed. Tall oil is heated to approximately 185° F. and piped into a mixing mill. At the same time, water containing the emulsifying agent is piped into the mill. In the Preferred Embodiment, the emulsifying agent is a nonylphenol ethoxylate surfactant with 75 moles of ethoxilation proportioned at 1% by weight of final emulsion, based upon a 100% active form of surfactant and adjusted accordingly for aqueous forms that maybe less than 100% active. For example, a 70% active form of the surfactant will require a 1.43% addition rate. The water and emulsifying agent are heated to approximately 700 F before entering the mixing mill. The rate at which the pitch and surfactant and water solution are combined determine the final solids content of the emulsion, which in the case of the Preferred Embodiment is 40%. The mixing mill provides a shear motion to the tall oil, breaking it up into small globules which then become suspended in the water solution. The surfactant aids the emulsification process and serves to keep the tall oil globules from coalescing with one another. The greater the shear applied, the smaller the tall oil globules formed. In general, the smaller the globules, the more stable and homogeneous is the finished tall oil emulsion 20, as shown contained within storage tank 10 in FIG. 1. The weight of the finished tall oil emulsion 20 at 40% solids content is approximately 8.32 lbs. per gallon.

As is illustrated in FIG. 1, the tall oil emulsion 20 is then nozzle-sprayed into free-falling coal fines 22 from a number of angles and sides so as to promote maximal treating. In the Preferred Embodiment, the coal fines 22 are sprayed in free fall from a conveyor 16 into a hopper 30. In the Preferred Embodiment, a first spray nozzle 23 and a second spray nozzle 24 located at a first angle and a second angle, respectively, with respect to the free-falling coal fines 22 are used. The amount of emulsion sprayed onto the fines is regulated by adjustable spray forces applied to the nozzles 23, 24. This results in emulsion-treated coal fines 25, as shown in FIG. 1. The emulsion-treated coal fines 25 then continue through into a pug mill (not shown) to further facilitate even distribution of the emulsion throughout the coal fines. Thereafter, the emulsion-treated coal fines 25 (solid synthetic fuel) are conveyed to a stack-out pile (not shown), or may be agglomerated, such as pelletizing or briquetting (not shown). The use of dryers (not shown) may also be used to facilitate the evaporation of the water off the emulsion-treated coal fines 25. However, it is a desired feature of this method to minimize the need for drying and removal of excess water by emulsifying the tall oil in advance of application which facilitates accurate control of the amount of tall oil solids and water (tall oil emulsion 20) applied.

FIG. 2 through FIG. 6 depict data taken from Fourier Transform Infrared (FTIR) analyses of samples containing varying degrees of tall oil emulsion combined with coal fines (referred to as "product"), compared to analyses of samples of the tall oil emulsion and coal fines taken separately (referred to as "simple mixture"). They suggest that when coal fines are brought together with tall oil mix in the process of the present invention, there is a chemical reaction between the coal fines and the tall oil that results in synthetic fuel. These figures reflect amounts of tall oil emulsion (at 40% solids) added from 0.5% to 1.5% by weight of coal, as seen in Tables 1–5, shown below. The nondestructive FTIR analyses are able to explore coal's functional group content. "Functional groups" refers to chemical species bonded to aromatic carbon ring structure sites where chemical reactions commonly take place. This analytical technique identifies molecular vibrations due to the absorption of infrared radiation by functional groups with characteristic absorption bands. Such testing is able to ascertain the presence of significant chemical changes in a sample of the tall oil emulsion treated coal fines, in comparison with un-treated coal fines.

In order to obtain the spectra shown in FIG. 2 through FIG. 6, the samples were imbedded in potassium bromide pellets, and light in the infrared range of 400–4000 $cm^{-1}$ was passed through the pellets. The chemical bonds present determine the absorption spectrum. For example, typically triple bonds and hydrogen stretching are represented by a spectral region of 4000 $cm^{-1}$ to approximately 1800 $cm^{-}$. Double bonded structures and aromatic structures have an FTIR range of approximately 1800 $cm^{-1}$ to 1400 $cm^{-1}$. Single bond structures consisting of various aromatic substitution bonding have an FTIR range from 1000–400 $cm^{-1}$. Supporting Fourier Transform Infrared (FTIR) data from other laboratories not using potassium bromide pellets and preparing samples with other methodology yield similar results.

Separate scans of the samples were done and the baselines adjusted for accuracy in the context of comparing the base materials and the manufactured fuel product, and the results can be seen in FIG. 2 through FIG. 6. The differences in peak absorption is a strong indication that the coal fines do in fact react with the tall oil emulsion.

The details that have been provided here regarding the Preferred Embodiment of the present invention are by way of example only and are in no way intended to limit the scope of the claimed invention.

TABLE 1

Comparison of FTIR Results for Parent Feed and Fuel Product, 0.5% binder

| Absorption peak wave number in $cm^{-1}$ | Possible peak identification | Peak area for parent feed | Peak area for fuel product | Percent change |
|---|---|---|---|---|
| 3386 | hydroxyl groups | 45.5800 | 41.9962 | 9 |
| 3037 | aromatic CH | 3.1771 | 3.0112 | 6 |
| 2916 | aliphatic CH | 41.1173 | 39.8782 | 3 |
| 1596 | aromatic ring enhanced by OH bonded C═O group | 64.4261 | 62.2182 | 4 |
| 1439 | aliphatic $CH_2$ and $CH_3$ | 25.8677 | 24.1699 | 7 |
| 1373 | cyclic $CH_2$ | 0.8716 | 0.9178 | 5 |
| 1258 | C—O and C—O—C | 0.9876 | 0.9981 | 1 |
| 1174 | C—O and C—O—C | 5.2676 | 6.6218 | 26 |
| 1102 | ethers, esters | 1.1618 | 0.0000 | removed |
| 1032 | C—O and Si—O | 33.5047 | 21.7171 | 54 |
| 918 | alkenes, aldehydes | 0.9291 | 0.0000 | removed |
| 858 | | 1.9846 | 2.6313 | 33 |
| 806 | polycyclic aromatic skeletal structure | 4.7183 | 4.2177 | 12 |
| 749 | | 2.5517 | 3.2966 | 29 |
| 698 | aromatic substitution | 1.8247 | 1.0264 | 78 |
| 535 | carboxyl groups, thiophenes, heterocyclics | 16.8305 | 13.7271 | 23 |
| 469 | Branched and cyclo-alkanes and aliphatic ethers | 9.6374 | 5.9012 | 63 |
| 424 | carbonyl, ketones | 1.1155 | 0.6342 | 76 |
| | | | | ave. 27 |

TABLE 2

Comparison of FTIR Results for Parent Feed and Fuel Product, 0.75% binder

| Absorption peak wave number in $cm^{-1}$ | Possible peak identification | Peak area for parent feed | Peak area for fuel product | Percent change |
|---|---|---|---|---|
| 3386 | hydroxyl groups | 45.0112 | 44.5350 | 1 |
| 3043 | aromatic CH | 3.0967 | 3.0786 | 1 |
| 2916 | aliphatic CH | 39.6251 | 42.5361 | 7 |
| 1596 | aromatic ring enhanced by OH bonded C═O group | 62.9332 | 62.3944 | 1 |
| 1436 | aliphatic $CH_2$ and $CH_3$ | 25.2640 | 24.3238 | 4 |
| 1370 | cyclic $CH_2$ | 0.8522 | 0.9002 | 6 |
| 1258 | C—O and C—O—C | 1.0687 | 0.9906 | 8 |
| 1174 | C—O and C—O—C | 4.9082 | 6.1183 | 25 |
| 1111 | ethers, esters | 1.0283 | 0.7372 | 39 |
| 1032 | C—O and Si—O | 33.5262 | 26.1635 | 28 |
| 918 | alkenes, aldehydes | 0.6674 | 0.5090 | 31 |
| 861 | | 1.9388 | 2.3177 | 20 |
| 803 | polycyclic aromatic skeletal structure | 4.6127 | 4.3129 | 7 |
| 749 | | 2.4942 | 2.8145 | 13 |
| 698 | aromatic substitution | 1.8536 | 1.4927 | 24 |
| 535 | carboxyl groups, thiophenes, heterocyclics | 16.8466 | 15.4300 | 9 |
| 472 | Branched and cyclo-alkanes and aliphatic ethers | 9.6514 | 8.0703 | 20 |
| 427 | carbonyl, ketones | 1.0842 | 0.8475 | 28 |
| | | | | ave. 15 |

TABLE 3

Comparison of FTIR Results for Parent Feed and Fuel Product 1% binder

| Absorption peak wave number in $cm^{-1}$ | Possible peak identification | Peak area for parent feed | Peak area for fuel product | Percent change |
|---|---|---|---|---|
| 3386 | hydroxyl groups | 45.5033 | 42.8306 | 6 |
| 3043 | aromatic CH | 3.0904 | 2.9870 | 3 |
| 2916 | aliphatic CH | 40.0238 | 42.3137 | 6 |
| 1593 | aromatic ring enhanced by OH bonded C═O group | 62.9355 | 61.5011 | 2 |
| 1436 | aliphatic $CH_2$ and $CH_3$ | 25.2630 | 25.1519 | 0 |
| 1370 | cyclic $CH_2$ | 0.8533 | 0.9634 | 13 |
| 1252 | C—O and C—O—C | 1.0099 | 1.0838 | 7 |
| 1168 | C—O and C—O—C | 5.1077 | 5.4345 | 6 |
| 1108 | ethers, esters | 0.9852 | 0.7538 | 31 |
| 1032 | C—O and Si—O | 28.6857 | 23.2038 | 24 |
| 915 | alkenes, aldehydes | 0.7853 | 0.4584 | 71 |
| 861 | | 1.9390 | 2.2944 | 18 |
| 803 | polycyclic aromatic skeletal structure | 4.6168 | 4.2883 | 8 |
| 749 | | 2.4959 | 2.9337 | 18 |
| 698 | aromatic substitution | 1.5561 | 1.3995 | 11 |
| 535 | carboxyl groups, thiophenes, heterocyclics | 14.8296 | 12.9285 | 15 |

TABLE 3-continued

Comparison of FTIR Results for Parent Feed and Fuel Product 1% binder

| Absorption peak wave number in $cm^{-1}$ | Possible peak identification | Peak area for parent feed | Peak area for fuel product | Percent change |
|---|---|---|---|---|
| 469 | Branched and cyclo-alkanes and aliphatic ethers | 8.2766 | 6.7904 | 22 |
| 427 | carbonyl, ketones | 1.0709 | 0.9498 | 13 |
| | | | | ave. 15 |

TABLE 4

Comparison of FTIR Results for Parent Feed and Fuel Product 1.25% binder

| Absorption peak wave number in $cm^{-1}$ | Possible peak identification | Peak area for parent feed | Peak area for fuel product | Percent change |
|---|---|---|---|---|
| 3386 | hydroxyl groups | 45.9981 | 46.5494 | 1 |
| 3043 | aromatic CH | 3.0840 | 2.8547 | 8 |
| 2916 | aliphatic CH | 40.0739 | 42.7524 | 7 |
| 1599 | aromatic ring enhanced by OH bonded C═O group | 62.5525 | 61.3507 | 2 |
| 1436 | aliphatic $CH_2$ and $CH_3$ | 24.6754 | 23.8952 | 3 |
| 1373 | cyclic $CH_2$ | 0.8542 | 0.9535 | 12 |
| 1252 | C—O and C—O—C | 1.1119 | 1.0077 | 10 |
| 1177 | C—O and C—O—C | 5.0252 | 5.9054 | 18 |
| 1108 | ethers, esters | 0.9864 | 0.7013 | 41 |
| 1032 | C—O and Si—O | 33.3901 | 26.2324 | 27 |
| 918 | alkenes, aldehydes | 0.7939 | 0.4602 | 73 |
| 858 | | 1.9394 | 2.1960 | 13 |
| 800 | polycyclic aromatic skeletal structure | 4.6210 | 4.2892 | 8 |
| 749 | | 2.4977 | 2.9254 | 17 |
| 698 | aromatic substitution | 1.8269 | 1.4589 | 25 |
| 535 | carboxyl groups, thiophenes, heterocyclics | 16.8414 | 15.9147 | 6 |
| 472 | Branched and cyclo-alkanes and aliphatic ethers | 9.6561 | 8.0995 | 19 |
| 427 | carbonyl, ketones | 1.1232 | 0.9406 | 19 |
| | | | | ave. 17 |

TABLE 5

Comparison of FTIR Results for Parent Feed and Fuel Product 1.5% binder

| Absorption peak wave number in $cm^{-1}$ | Possible peak identification | Peak area for parent feed | Peak area for fuel product | Percent change |
|---|---|---|---|---|
| 3380 | hydroxyl groups | 46.4957 | 41.3142 | 13 |
| 3043 | aromatic CH | 3.0773 | 2.8595 | 8 |
| 2916 | aliphatic CH | 40.3441 | 43.5053 | 8 |
| 1596 | aromatic ring enhanced by OH bonded C═O group | 61.8963 | 61.6030 | 0 |
| 1436 | aliphatic $CH_2$ and $CH_3$ | 24.6763 | 23.9078 | 3 |

TABLE 5-continued

Comparison of FTIR Results for Parent Feed and Fuel Product 1.5% binder

| Absorption peak wave number in $cm^{-1}$ | Possible peak identification | Peak area for parent feed | Peak area for fuel product | Percent change |
|---|---|---|---|---|
| 1373 | cyclic $CH_2$ | 0.8551 | 1.0021 | 17 |
| 1255 | C—O and C—O—C | 1.0412 | 0.9865 | 6 |
| 1171 | C—O and C—O—C | 5.0542 | 6.4190 | 27 |
| 1108 | ethers, esters | 1.1682 | 0.6352 | 84 |
| 1029 | C—O and Si—O | 33.4953 | 27.7601 | 21 |
| 918 | alkenes, aldehydes | 0.8031 | 0.4636 | 73 |
| 861 | | 1.9397 | 2.3452 | 21 |
| 800 | polycyclic aromatic skeletal structure | 4.6251 | 4.1618 | 11 |
| 749 | | 2.4987 | 3.0571 | 22 |
| 695 | aromatic substitution | 1.8145 | 1.5304 | 19 |
| 535 | carboxyl groups, thiophenes, heterocyclics | 16.8145 | 15.9566 | 5 |
| 469 | Branched and cyclo-alkanes and aliphatic ethers | 9.6717 | 8.2476 | 17 |
| 424 | carbonyl, ketones | 1.0785 | 0.9090 | 19 |
| | | | | ave. 21 |

What is claimed is:

1. A method of producing a synthetic fuel, said method comprising the steps of:

(a) preparing an emulsion comprising a tall-oil-mix and water, and (b) reacting said emulsion with coal fines of bituminous coal so as to obtain said synthetic fuel comprising emulsion-treated coal fines.

2. The method of claim 1 wherein said step of reacting includes spraying said emulsion into a stream of said coal fines.

3. The method of claim 2 wherein said stream is made up of said coal fines falling substantially vertically under gravity.

4. The method of claim 2, wherein said step of spraying includes providing an emulsion delivery system that includes one or more nozzles that are oriented substantially horizontally and directed at said stream.

5. The method of claim 4 further comprising a step of controlling a rate of spray of said emulsion onto said coal fines by providing adjustable spray forces at said one or more nozzles.

6. The method of claim 5, further comprising a step of adjusting said rate of spray so as to achieve optimal evaporation of water from said emulsion-treated coal fines.

7. The method of claim 6 further comprising a step of applying heat to said emulsion-treated coal fines to evaporate excess water.

8. A synthetic fuel produced by the method of claim 1.

9. The method of claim 1 further comprising the step of agglomerating said solid synthetic fuel.

10. A method of producing a synthetic fuel, said method comprising the steps of:

a) heating a tall oil mix to about 185° F.;

b) heating water and an emulsifying agent to approximately 70° F.;

c) mixing said tall oil mix, said water, and said emulsifying agent into a tall oil emulsion;

d) spraying said tall oil emulsion into a stream of free-falling coal fines, thereby forming a solid synthetic fuel; and e) mixing said solid synthetic fuel in a pug mill to ensure homogeneity.

11. The method of claim 10 further comprising the step of forming said solid synthetic fuel into briquettes.

12. The method of claim 10, wherein said tall-oil mix comprises substantially tall oil pitch and said coal fines are fines of bituminous coal.

13. The method of claim 10, wherein said emulsifying agent is nonylphenol ethoxylate surfactant.

14. The method of claim 10, wherein said tall-oil mix, said water, and said emulsifying agent are combined so as to obtain a finished tall-oil-emulsion containing 40% by weight of tall oil solids.

15. The method of claim 10, wherein said emulsion includes said tall-oil mix in suspension in water.

16. The method of claim 10, wherein said emulsion includes said tall-oil mix in solution in water.

17. The method of claim 1, wherein said tall-oil mix comprises substantially tall-oil pitch.

18. The method of claim 1, wherein said emulsion includes said tall-oil mix in suspension in water.

19. The method of claim 1, wherein said emulsion includes said tall-oil mix in solution in water.

* * * * *

UNITED STATES PATENT AND TRADEMARK OFFICE

CERTIFICATE OF CORRECTION

PATENT NO. : 6,558,442 B2
DATED : May 6, 2003
INVENTOR(S) : Paul Donovan

It is certified that error appears in the above-identified patent and that said Letters Patent is hereby corrected as shown below:

Column 4,
Line 63, “75 moles” should read -- 70 moles --

Column 5,
Line 2, “700 F” should read -- 70ºF --

Column 6,
Line 12, “$cm^{-}$.” should read -- $cm^{-1}$ --.

Signed and Sealed this

Twenty-third Day of September, 2003

JAMES E. ROGAN
*Director of the United States Patent and Trademark Office*